US008210790B1

(12) United States Patent
Sharp

(10) Patent No.: US 8,210,790 B1
(45) Date of Patent: Jul. 3, 2012

(54) PALLET AND PRODUCT PROTECTOR

(76) Inventor: Geoffrey R. Sharp, Visalia, CA (US)

( * ) Notice: Subject to any disclaimer, the term of this patent is extended or adjusted under 35 U.S.C. 154(b) by 0 days.

(21) Appl. No.: 13/298,755

(22) Filed: Nov. 17, 2011

(51) Int. Cl.
*B66F 9/14* (2006.01)

(52) U.S. Cl. ..... 414/665; 414/639

(58) Field of Classification Search ..... 267/136; 414/607, 621, 622, 639, 671, 785, 665–667; 187/237, 238
See application file for complete search history.

(56) References Cited

U.S. PATENT DOCUMENTS 2,608,315 A * 8/1952 Turner ..... 414/641
2,956,701 A * 10/1960 Larson ..... 414/785
2,958,436 A * 11/1960 Skutle et al. ..... 414/667
3,080,080 A * 3/1963 Miller ..... 414/785
3,556,328 A * 1/1971 Miles et al. ..... 414/607
4,050,599 A * 9/1977 Bender ..... 414/659
4,102,464 A * 7/1978 Schuster ..... 414/785
4,106,650 A * 8/1978 Blackstone et al. ..... 414/785
4,239,446 A * 12/1980 Vucinic ..... 414/785
4,505,635 A * 3/1985 Shinoda et al. ..... 414/667

* cited by examiner

*Primary Examiner* — Christopher Schwartz
(74) *Attorney, Agent, or Firm* — Maier & Maier, PLLC

(57) ABSTRACT

A pallet and product protector for use with a forklift having a carriage assembly and a pair of L-shaped forks, including a horizontally elongated plate having a pair of cutouts defined in the lower edge thereof, each cutout being sized and shaped to receive a horizontal tong of an L-shaped fork, and a vertically elongated plate disposed rearward of the horizontally elongated plate and coupled thereto by a pivotable coupling.

20 Claims, 5 Drawing Sheets

PALLET AND PRODUCT PROTECTOR

BACKGROUND

Lift trucks, also known as forklifts, are commonly used in warehousing, storage, and similar applications to transport packaged materials between locations, and to raise and stack packaged materials for storage. To facilitate transporting and lifting the materials, such materials are typically packaged and disposed on top of a pallet. Commonly used pallets are constructed from wood and have a bottom deck and a top deck coupled to a plurality of parallel stringers disposed therebetween, with openings provided between the stringers. A pallet can have a pair of stringers disposed at the edges of the pallet, and a third stringer disposed substantially halfway between the pair of stringers. Forklifts have a pair of movable L-shaped members, or forks, that are inserted into the openings. Once the forks are disposed within the openings, the forklift can lift and transport the pallet.

During operations, forklifts can impact the pallet with the vertical portions of the forks. The force of these impacts is applied to the top deck of the pallet and to the goods disposed on top of the pallet and that may be overhanging the pallet. Consequently, individuals and businesses suffer significant losses due to product damage, pallet damage, as well as due to the labor involved in replacing pallets and products and restacking products on undamaged pallets.

SUMMARY

According to at least one exemplary embodiment, a pallet and product protector for use with a forklift having a carriage assembly and a pair of L-shaped forks may be disclosed. The pallet and product protector can include a horizontally elongated plate having a pair of cutouts defined in the lower edge thereof, each cutout being sized and shaped to receive a horizontal tong of an L-shaped fork, and a vertically elongated plate disposed rearward of the horizontally elongated plate and coupled thereto by a pivotable coupling.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
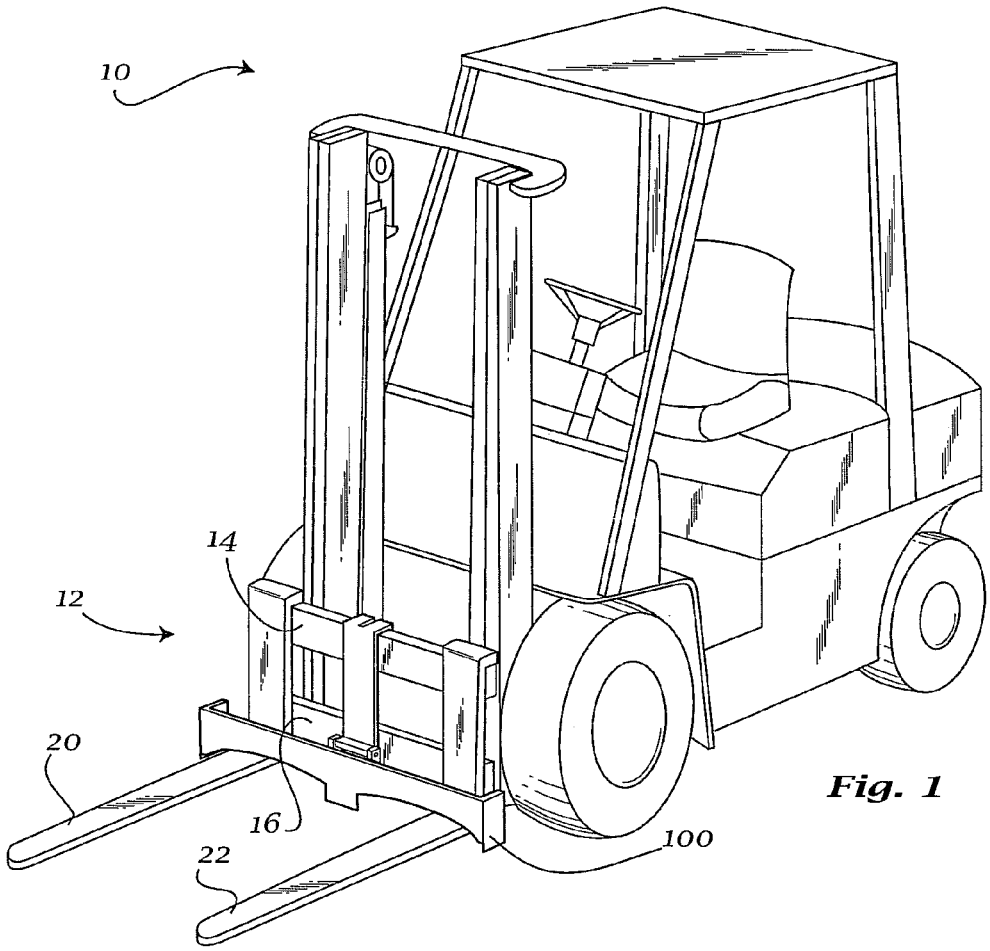
FIG. 1 shows an exemplary embodiment of a pallet and product protector attached to a forklift.

FIG. 1 shows an exemplary embodiment of a pallet and product protector 100 attached to a forklift 10 having a pair of L-shaped forks 20, 22. Typically, forks 20, 22 can be a part of a carriage assembly 12. The carriage assembly 12 can include an upper carriage bar 14 and a lower carriage bar 16. Carriage assembly 12 can be vertically adjustable, while forks 20, 22 can be laterally adjustable with respect to each other and to carriage assembly 12.

FIGS. 2*a*-2*e* show an exemplary embodiment of a pallet and product protector 100. Pallet and product protector 100 may include a horizontally elongated front plate 110 and a vertically elongated plate 150 disposed rearward of front plate 110 and coupled thereto. Plates 110 and 150 may be coupled such that front plate 110 is positioned substantially near the lower end of vertically elongated plate 150 and may extend below vertically elongated plate 150. Vertically elongated plate 150 may include a pair of mounting members 152 disposed adjacent the top end thereof. Mounting members 152 can be sized and shaped to facilitate removably attaching pallet and product protector 100 to the upper carriage bar 14 of a forklift or similar apparatus by positioning the mounting members 152 over upper carriage bar 14. To that end, in some exemplary embodiments, mounting members 150 may have a substantially hook-like configuration, and may extend rearward and downward from vertically elongated plate 150.

Figure 2A:
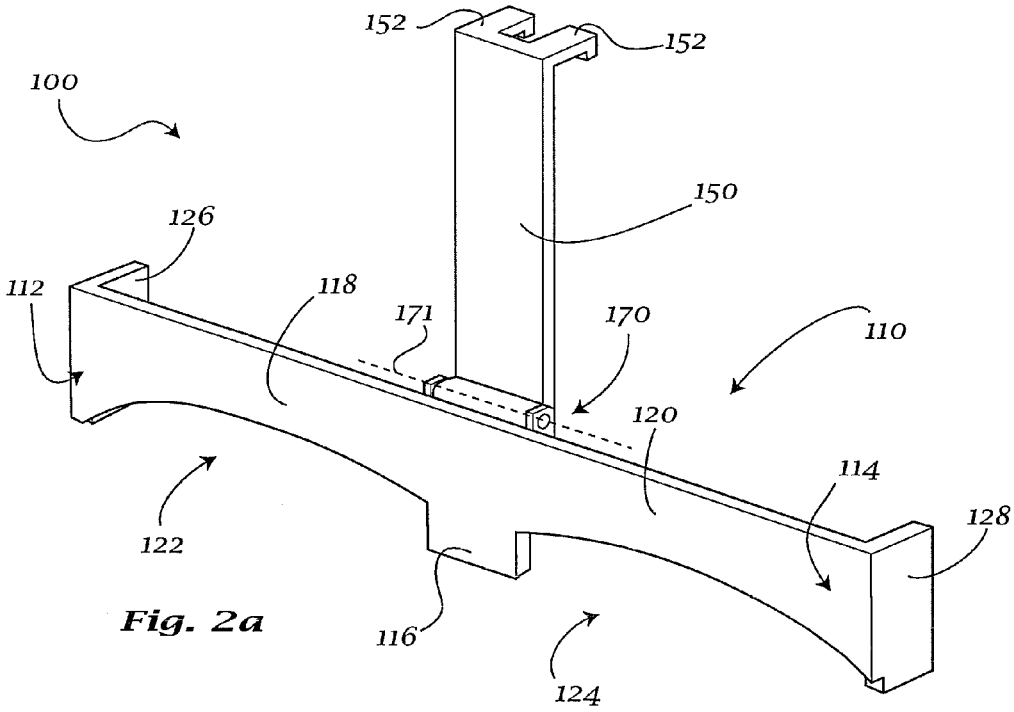
FIG. 2*a* is a front isometric view of an exemplary embodiment of a pallet and product protector.
Figure 2B:
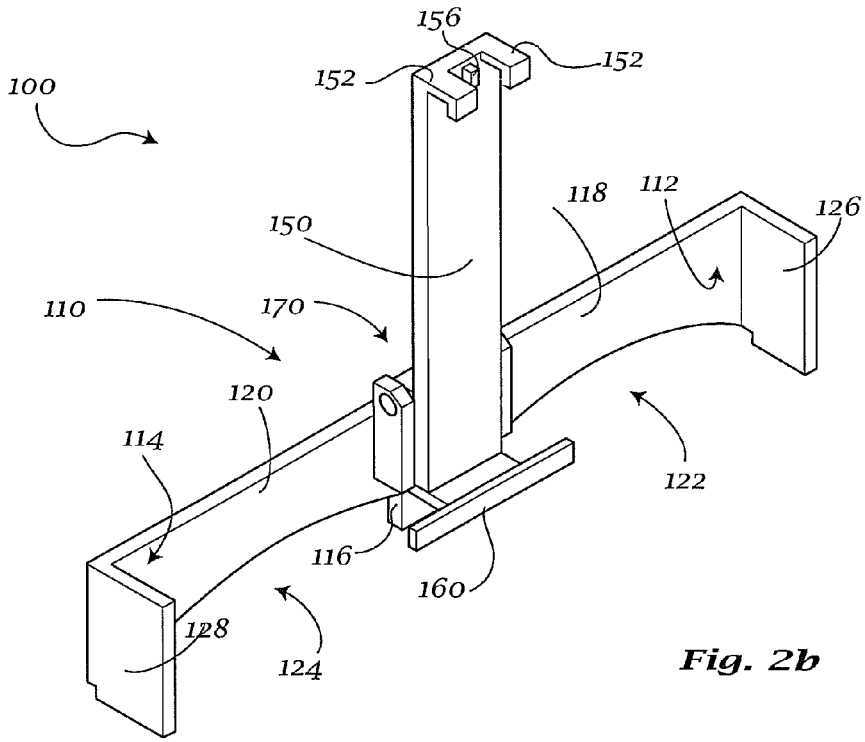
FIG. 2*b* is a rear isometric view of an exemplary embodiment of a pallet and product protector.

Front plate 110 may include a first impact portion 112, a second impact portion 114, and a middle impact portion 116. Extending between first impact portion 112 and middle impact portion 116 may be a first horizontally elongated portion 118, and extending between middle impact portion 116 and second impact portion 114 may be a second horizontally elongated portion 120. The height of first and second horizontally elongated portions 118, 120 may be less than the heights of first impact portion 112, second impact portion 114, and middle impact portion 116. The bottom edge of front plate 110 may thus be shaped so as to symmetrically define first and second cutouts 122, 124, while the top edge of front plate may be substantially horizontal. In some embodiments, cutouts 122, 124 may have a substantially arcuate shape, or a shape having vertical sides and an arcuate top, as shown in FIGS. 2*a*-2*b*. In other embodiments, cutouts 122, 124 may have a three-sided rectangular shape, or any other shape that enables pallet and product protector to function as described herein. Additionally, first impact portion 112 may include a rearward-extending portion 126, and second impact portion 114 may likewise include a rearward-extending portion 128.

Cutouts 122, 124 may be sized to receive the horizontal tongs of L-shaped forks 20, 200 of a forklift 10. As a forklift 10 may have forks that are laterally adjustable, cutouts 122, 124 may be sized so as to allow for the full range of lateral adjustability of the L-shaped forks. Therefore, in some embodiments, cutouts 122, 124 may extend from middle impact portion 116 out to the respective edges of front plate 110, so as to accommodate carriages having wide fork spreads. Furthermore, as shown in FIG. 1*a*, vertically elongated plate 150 may be sized such that when vertically elongated plate 150 is attached to an upper carriage bar 14 of a forklift, L-shaped forks 20, 22 may be received within cutouts 122, 124, while first impact portion 112, middle impact portion 116, and second impact portion 114 may extend below the plane of L-shaped forks 22, 24.

Figure 2C:
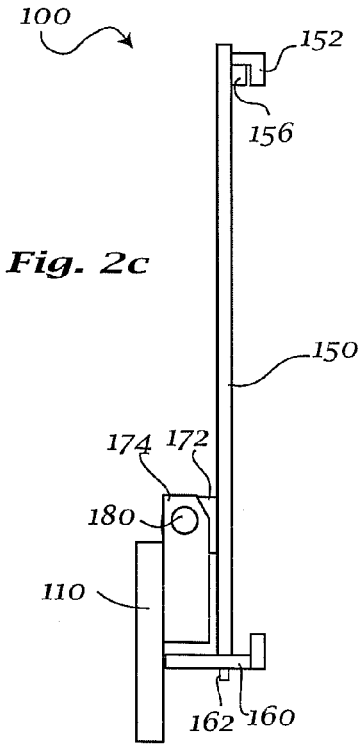
FIGS. 2*c*-2*d* are side elevational views of an exemplary embodiment of a pallet protector, illustrating the pivoting action of the front plate.
Figure 2D:
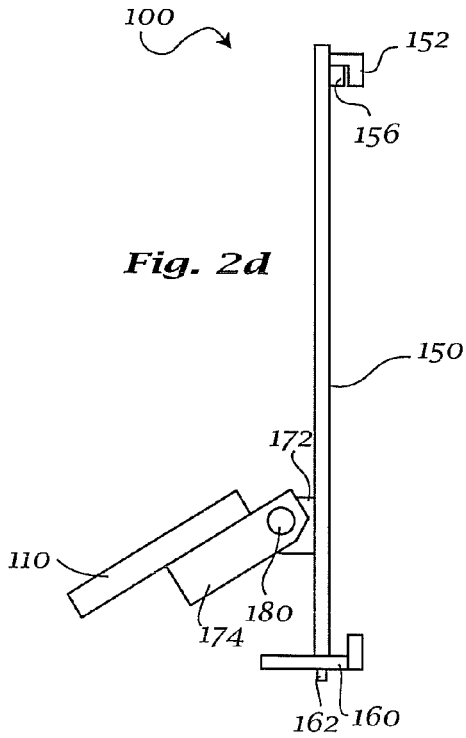
Figure 2E:
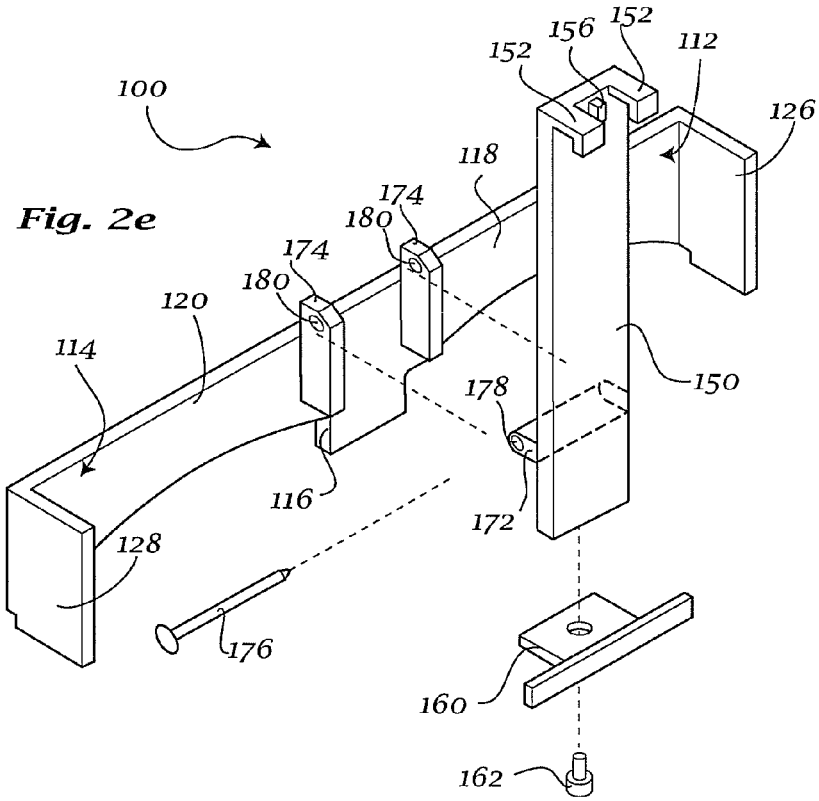
FIG. 2*e* is an exploded rear isometric view of an exemplary embodiment of a pallet and product protector.

Front plate 110 may be coupled to vertically elongated plate 150 by a hinged coupling 170. Hinged coupling 170 can allow front plate 110 to pivot with respect to vertically elongated plate 150. Pivotable coupling 170 can be disposed such that the axis of rotation 171 of front plate 110 is located proximate the top edge of front plate 110. Furthermore, the axis of rotation 171 can be oriented substantially parallel to the longitudinal axis of front plate 110. This arrangement can allow the bottom edge of front plate 110 can move in an arc forwardly and upwardly from its initial location, as shown in FIGS. 2*c*-2*d*. The pivoting action of front plate 110 can act so as to provide clearance for withdrawing any portion of a pallet or a product that may be caught on a portion of front plate 110.

Hinged coupling 170 may be any type of hinged coupling that allows pallet and product protector to function as described herein. In some exemplary embodiments, hinged coupling 170 may be facilitated by a barrel portion 172, a pair of spacer members 174, and a pin 176. Barrel portion 172 may be coupled to vertically elongated plate 150 and may have a bore 178 defined therein. Spacer members 174 may be coupled to front plate 110 and may each have a bore 180 defined therein. Spacer members 174 may be positioned such that barrel portion 172 can be disposed between the spacer members 174 and such that bores 178, 180 are aligned. Pin 176 may then be inserted through 178, 180 and may be retained therein by any known retention structure that enables protector 100 to function as described herein. In some exemplary embodiments, barrel portion 172 may be coupled proximate the top edge of front plate 110, while spacer members 174 may be coupled to vertically elongated plate 150.

A forklift 10 typically has carriage bars 14, 16 disposed behind L-shaped forks 20, 22. Thus, spacer members 174 can have any desired width, so as to provide a desired clearance between plates 110, 150 that can enable vertically elongated plate 150 to be attached to upper carriage bar 14, and front plate 110 to be disposed in front of the vertical portions of L-shaped forks 20, 22 and pivotably coupled to vertically elongated plate 150.

Figure 3A:
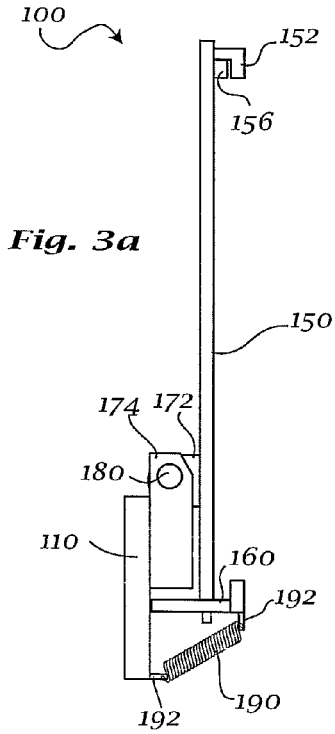
FIGS. 3*a*-3*b* are side elevational views of another exemplary embodiment of a pallet protector, illustrating the pivoting action of the front plate.
Figure 3B:
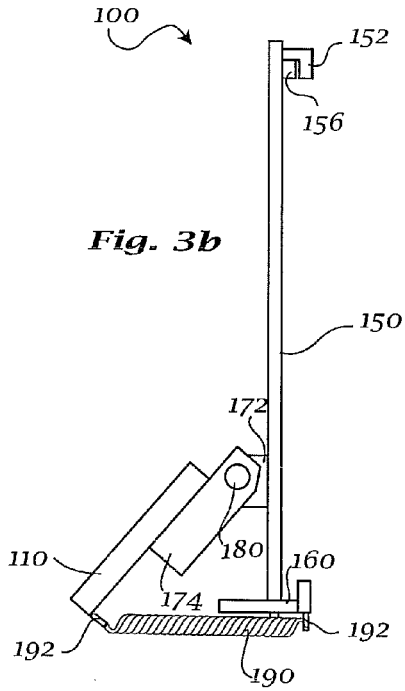
Figure 3C:
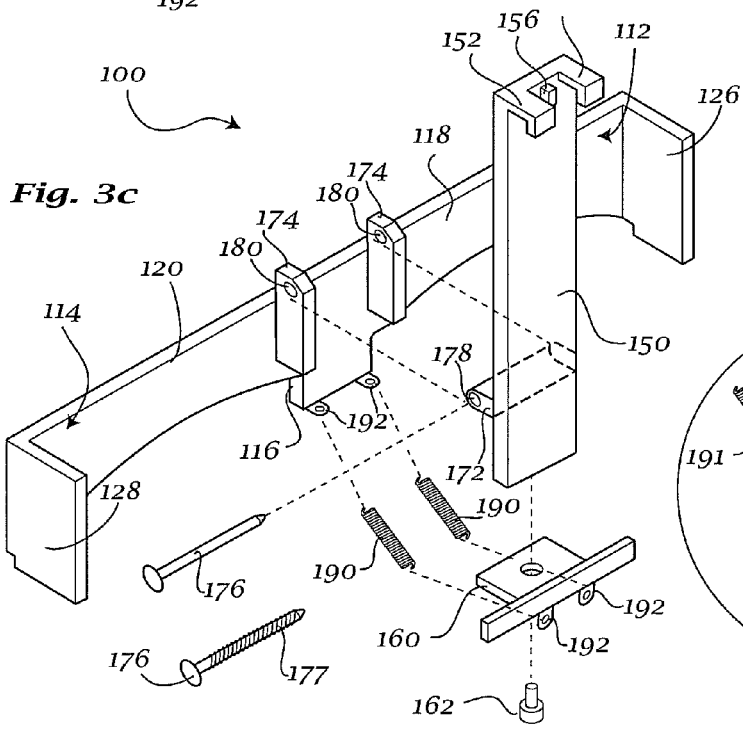
FIG. 3*c* is an exploded rear isometric view of the exemplary embodiment of FIG. 3*a*.
Figure 3D:
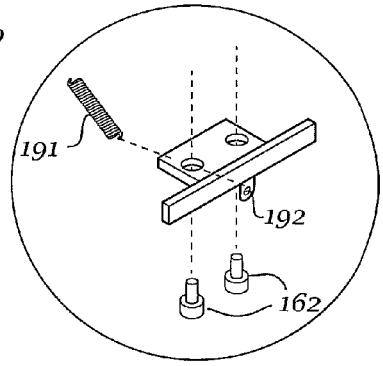
FIG. 3*d* is a partial exploded rear isometric view of the exemplary embodiment of FIG. 3*a*, showing an alternative mounting member.

Pallet and product protector 100 may further include a clamping member 160 that can be removably coupled to the bottom end of vertically elongated portion 150, or, alternatively, to a spacer member 154, or to a plate coupled thereto. Clamping member 160 may engage bottom carriage bar 16 of a forklift 10, so as to facilitate securing pallet and product protector 100 to carriage assembly 12. Furthermore, diverse models of forklifts may have varying distances between upper and lower carriage bars 14, 16. Therefore, the vertical position of clamping member 160 may be adjustable so as to allow pallet and product protector 100 to couple to diverse forklift models. The coupling of clamping member 160 may be facilitated by a fastener 162, for example a screw, bolt, or any other known fastener that allows the vertical position of clamping member 160 to be adjusted as desired. In some exemplary embodiments, for example for heavy-duty applications, clamping member 160 may be coupled by at least two fasteners 162, as shown in FIG. 3*d*.

In some exemplary embodiments, as shown in FIGS. 3*a*-3*d*, at least one resilient member 190, for example a coil spring or the like, may be coupled to front plate 110 and clamping member 160. Coupling structures 192, for example apertures, eyelets, or the like, may be provided on front plate 110 and clamping member 160, and resilient member 190 may be attached thereto. Resilient members 190 can facilitate returning front plate 110 into the initial position after front plate 110 has been pivoted away from the initial position. Resilient members 190 can also facilitate providing a limit on the range of pivotability of front plate 110. Therefore, the coupling structures 192 for resilient members 190 can be provided in any desired location on clamping member 160, so as to achieve the desired limits on pivotability range of front plate 110 and/or the desired tension of resilient members 190. In the exemplary embodiment of FIG. 3*d*, wherein at least two fasteners 162 are used for coupling clamping member 160, a single heavy-duty resilient member 191 may be used in lieu of a pair of resilient members 190. In yet other exemplary embodiments, a torsion spring 177, disposed around pin 176 and received within bore 178 of barrel portion 172, may be used to facilitate returning front plate 110 into the initial position, in lieu of resilient members 190 or 191.

Certain carriage bars may include a plurality of regularly spaced index notches provided along the upper portion of the carriage bar. Such index notches can facilitate the positioning of L-shaped forks or other attachments along the carriage bar. Exemplary embodiments of pallet and product protector 100 may thus include a centering nub 156 disposed substantially near the top end of vertically elongated plate 150. Centering nub 156 may be adapted to be received within an index notch of a carriage bar, so as to facilitate precise positioning of pallet and product protector 100 at the midpoint of the carriage bar or at another desired index notch.

Figure 4:
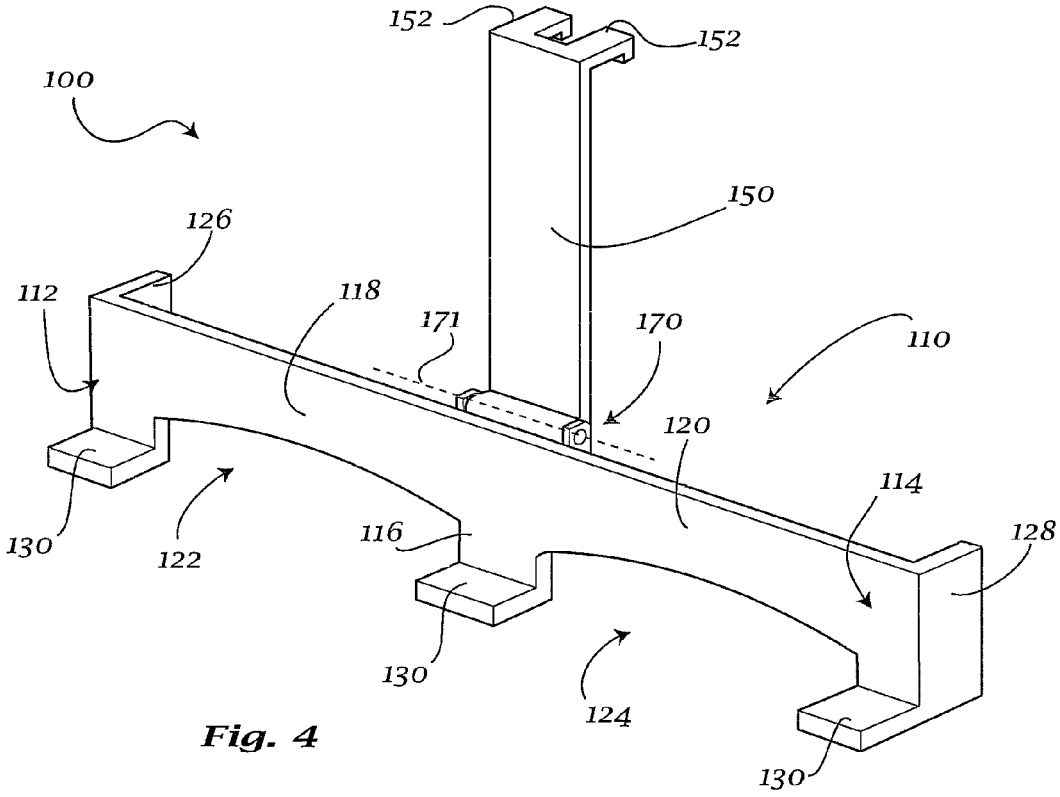
FIG. 4 is a front isometric view of another exemplary embodiment of a pallet and product protector.

Pallets may have materials loaded thereon that overhang the edge of the pallet. Embodiments of pallet and product protector 100 may include horizontal extensions 130 coupled to each of first impact portion 112, second impact portion 114, and middle impact portion 116, substantially near the bottom ends thereof, as shown in FIG. 4. Extensions 130 may serve to provide additional clearance between the pallet and front plate 100 so as to reduce the likelihood of contact between materials that are overhanging the pallet and the forklift.

In operation, pallet and product protector 100 can be attached to the carriage assembly 12 of a forklift 10, substantially as described above and as shown in FIG. 1*a*. The operator can then proceed with loading the pallet onto the forklift, by inserting the horizontal portions of L-shaped tongs 20, 22 into the spaces provided between the stringers of a pallet. As the L-shaped tongs are moved into position underneath the pallet, front plate 110 can come into contact with, or can impact, the upper deck of the pallet. Furthermore, center impact portion 116 can come into contact with, or can impact, the middle stringer of the pallet, while first and second impact portions 112, 114 can come into contact with, or can impact, the stringers disposed along the edges of the pallet. The impact force can thus be distributed along a greater contact area than if the pallet were to be impacted solely by the vertical portions of L-shaped forks 20, 22, and damage to the pallet may be prevented. Additionally, as pallet and product protector 100 is disposed forward of L-shaped forks 20, 22, and substantially at the height of the pallet when it is proximate to the forklift, any materials that are loaded on the pallet are not likely to come into contact with, or impact, forks 20, 22 or pallet and product protector 100, thereby reducing the likelihood of damage to the materials. Furthermore, extensions 130 may provide additional clearance between the pallet and the forklift, further reducing the likelihood of damage to the materials.

Occasionally, during loading, moving, and unloading operations, a portion of a pallet or the products thereon may catch on a portion of front plate 110 of protector 100. This can encumber the operation of forklift 10, for example during unloading operations. In the event a portion of the pallet or the products thereon are caught on a portion of front plate 110, front plate 110 can pivot upwardly during unloading operations so as to allow the pallet to be unloaded without interference from front plate 110. Front plate 110 can then be returned to its initial position via the action of resilient members 190.

During pallet loading and unloading operations, a forklift may approach the pallet at an oblique angle. Oblique impacts may also impart damage to the pallet and to the materials loaded thereon. Therefore, the rearward extending portions 126, 128 of impact portions 112, 114 may reduce the likelihood of damage from oblique impacts.

It should be appreciated that the exemplary embodiments of pallet and product protectors disclosed herein may include impact-absorbing members coupled thereto. Such impact absorbing members may be made out of any known impact absorbing material, for example a resiliently deformable material such as plastic, rubber or foam. Furthermore, the above-described components of the pallet and product protectors may be made from metal, plastic, wood, or any other desired material that enables the pallet and product protectors to function therein, or any combination of such materials. It should also be appreciated that the above-described components of the pallet and product protectors may be coupled to each other by any known coupling. For example, the above described components may be fixedly coupled to each other by welding, adhesion, or any other known coupling. The above described components may also be removably coupled to each other, for example by screws, bolts, dowels, or any other known coupling. Additional couplings of components of the exemplary embodiments of the pallet and product protectors may be contemplated and used as desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A pallet and product protector for use with a forklift having a carriage assembly and a pair of L-shaped forks, comprising:

a horizontally elongated plate having a pair of cutouts defined in the lower edge thereof, each cutout being sized and shaped to receive a horizontal tong of an L-shaped fork; and a vertically elongated plate disposed rearward of the horizontally elongated plate and coupled thereto by a pivotable coupling.

2. The pallet and product protector of claim 1, further comprising a clamping member removably coupled to the pallet and product protector and disposed below the vertically elongated plate.

3. The pallet and product protector of claim 2, further comprising resilient members coupled to the horizontally elongated plate and the clamping member.

4. The pallet and product protector of claim 1, wherein the pivotable coupling is disposed proximate a top edge of the horizontally elongated plate.

5. The pallet and product protector of claim 1, wherein the front plate pivots about an axis of rotation, the axis of rotation being disposed proximate a top edge of the front plate, the axis of rotation further being parallel to the longitudinal axis of the horizontally elongated plate.

6. The pallet and product protector of claim 1, further comprising a first rearwardly extending portion disposed at a first end of the horizontally elongated plate and a second rearwardly extending portion disposed at a second end of the horizontally elongated plate.

7. A pallet and product protector for use with a forklift having a carriage assembly and a pair of L-shaped forks, comprising:

means for attaching the pallet and product protector to the carriage assembly of the forklift;

a first impact means for coming into contact with a center stringer of a pallet;

a second impact means for coming into contact with a first side stringer of the pallet; and a third impact means for coming into contact with a second side stringer of the pallet.

8. The pallet and product protector of claim 7, further comprising:

a first means for absorbing impacts between the pallet and product protector and the center stringer of a pallet;

a second means for absorbing impacts between the pallet and product protector and the first side stringer of the pallet; and a third means for absorbing impacts between the pallet and product protector and the second side stringer of the pallet.

9. The pallet and product protector of claim 7, further comprising means for providing clearance between the forklift and materials loaded onto and overhanging a pallet.

10. The pallet and product protector of claim 7, further comprising means for pivoting the first impact means, second impact means, and third impact means in relation to the attaching means.

11. A pallet and product protector for use with a forklift having a pair of L-shaped forks, comprising:

a front plate comprising a first impact portion having a height, a middle impact portion having a height, a second impact portion having a height, a first horizontally elongated portion having a height and extending between the first impact portion and the middle impact portion, and a second horizontally elongated portion having a height and extending between the second impact portion and the middle impact portion, the height of the first horizontally elongated portion and the height of the second horizontally elongated portion being less than the height of the middle impact portion;

a vertically elongated plate disposed rearward of the front plate and coupled thereto by a pivotable coupling, the vertically elongated plate further comprising a top end, a bottom end, and a pair of mounting members disposed adjacent the top end and extending rearward therefrom; and a clamping member disposed proximate to the middle impact portion of the front plate and below the vertically elongated plate.

12. The pallet and product protector of claim 11, wherein the front plate further comprises a top edge and a bottom edge, the bottom edge symmetrically defining a first cutout and a second cutout in the horizontally elongated plate, the first cutout being disposed between the first impact portion and the middle impact portion, and the second cutout being disposed between the second impact portion and the middle impact portion.

13. The pallet and product protector of claim 12, wherein each of the first cutout and the second cutout is adapted to receive a horizontal tong of an L-shaped fork of a forklift.

14. The pallet and product protector of claim 11, wherein the pivotable coupling is disposed proximate a top edge of the front plate.

15. The pallet and product protector of claim 11, wherein the front plate pivots about an axis of rotation, the axis of rotation being disposed proximate a top edge of the front plate, the axis of rotation further being parallel to the longitudinal axis of the front plate.

16. The pallet and product protector of claim 11, further comprising resilient members coupled to the front plate and the clamping member.

17. The pallet and product protector of claim 11, further comprising horizontal extensions coupled to each of the first impact portion, the middle impact portion, and the second impact portion, and extending forward therefrom.

18. The pallet and product protector of claim 11, wherein the clamping member is removably coupled to the pallet and product protector.

19. The pallet and product protector of claim 11, further comprising a centering nub disposed proximate the top end of the vertically elongated plate.

20. The pallet and product protector of claim 11, further comprising impact absorbing material coupled thereto.

* * * * *